US005489416A

United States Patent [19]

Takahashi et al.

[11] Patent Number: 5,489,416

[45] Date of Patent: Feb. 6, 1996

[54] HEAT-RESISTANT, AUSTENITIC CAST STEEL AND EXHAUST EQUIPMENT MEMBER MADE THEREOF

[75] Inventors: Norio Takahashi, Oomiya; Toshio Fujita, Tokyo, both of Japan

[73] Assignee: Hitachi Metals, Ltd., Japan

[21] Appl. No.: 390,945

[22] Filed: Feb. 21, 1995

Related U.S. Application Data

[63] Continuation of Ser. No. 187,732, Jan. 28, 1994, abandoned.

[30] Foreign Application Priority Data

Feb. 3, 1993 [JP] Japan ..... 5-016224
Feb. 3, 1993 [JP] Japan ..... 5-016225

[51] Int. Cl.[6] ..... C22C 38/26; C22C 38/60

[52] U.S. Cl. ..... 420/40; 420/41; 420/42

[58] Field of Search ..... 420/40, 41, 42, 420/54

[56] References Cited

U.S. PATENT DOCUMENTS

| | | | |
|---|---|---|---|
| 2,553,330 | 5/1951 | Post . | |
| 2,801,916 | 8/1957 | Harris et al. . | |
| 3,135,602 | 6/1964 | Eberle . | |
| 3,649,376 | 3/1972 | Decroix . | |
| 4,347,080 | 8/1982 | Yanagida et al. | 420/40 |
| 4,434,006 | 2/1984 | Kato . | |
| 4,837,108 | 6/1989 | Kimura et al. | 420/42 |
| 5,194,220 | 3/1993 | Takahashi et al. | 420/54 |

FOREIGN PATENT DOCUMENTS

| | | |
|---|---|---|
| 0471255 | 2/1992 | European Pat. Off. . |
| 1558668 | 5/1973 | Germany . |
| 3018537 | 11/1980 | Germany . |
| 46-16812 | 5/1971 | Japan . |
| 57-8183 | 2/1982 | Japan . |
| 61-87854 | 5/1986 | Japan . |
| 61-87852 | 5/1986 | Japan . |
| 61-177352 | 8/1986 | Japan . |
| 5-5161 | 1/1993 | Japan . |

*Primary Examiner*—Deborah Yee
*Attorney, Agent, or Firm*—Finnegan, Henderson, Farabow, Garrett & Dunner

[57] ABSTRACT

Exhaust equipment members are made of a heat-resistant, austenitic cast steel having a composition consisting essentially, by weight, of 0.1–0.6% of C, less than 1.5% of Si, 1% or less of Mn, 8–20% of Ni, 15–30% of Cr, 0.2–1% of Nb, 2–6% of W, 0.001–0.01% of B, 0.02–0.3% of S and/or 0.001–0.1% of REM (Ce, La, Nb or Pt), Mg or Ca, the balance being Fe and inevitable impurities.

8 Claims, No Drawings

HEAT-RESISTANT, AUSTENITIC CAST STEEL AND EXHAUST EQUIPMENT MEMBER MADE THEREOF

This application is a continuation of U.S. application Ser. No. 08/187,732, filed Jan. 28, 1994, now abandoned.

BACKGROUND OF THE INVENTION

The present invention relates to a heat-resistant cast steel suitable for exhaust equipment members for automobiles, etc., and more particularly to a heat-resistant, austenitic cast steel having excellent high-temperature strength and machinability, and an exhaust equipment member made of such a heat-resistant, austenitic cast steel.

Some of conventional heat-resistant cast iron and heat-resistant cast steel have compositions shown in Table 3 as Comparative Examples. In exhaust equipment members such as exhaust manifolds, turbine housings, etc. for automobiles, heat-resistant cast iron such as high-Si spheroidal graphite cast iron, heat-resistant cast steel such as ferritic cast steel, NI-RESIST cast iron (Ni-Cr-Cu austenitic cast iron) shown in Table 3, etc. are employed because their operating conditions are extremely severe at high temperatures.

Further, attempts have been made to propose various heat-resistant, austenitic cast steels. For instance, Japanese Patent Laid-Open No. 61-87852 discloses a heat-resistant, austenitic cast steel consisting essentially of C, Si, Mn, N, Ni, Cr, V, Nb, Ti, B, W and Fe showing improved creep strength and yield strength. In addition, Japanese Patent Laid-Open No. 61-177352 discloses a heat-resistant, austenitic cast steel consisting essentially of C, Si, Mn, Cr, Ni, Al, Ti, B, Nb and Fe having improved high-temperature and room-temperature properties by choosing particular oxygen content and index of cleanliness of steel. Japanese Patent Publication No. 57-8183 discloses a heat-resistant, austenitic cast Fe-Ni-Cr steel having increased carbon content and containing Nb and Co, thereby showing improved high-temperature strength without suffering from the decrease in high-temperature oxidation resistance.

Among these conventional heat-resistant cast irons and heat-resistant cast steels, for instance, the high-Si spheroidal graphite cast iron is relatively good in a room-temperature strength, but it is poor in a high-temperature strength and an oxidation resistance. Heat-resistant, ferritic cast steel is extremely poor in a high-temperature yield strength at 900° C. or higher. The NI-RESIST cast iron is relatively good in a high-temperature strength up to 900° C., but it is poor in durability at 900° C. or higher. Also, it is expensive because of high Ni content.

Since the heat-resistant, austenitic cast steel disclosed in Japanese Patent Laid-Open No. 61-87852 has a relatively low C content of 0.15 weight % or less, it shows an insufficient high-temperature strength at 900° C. or higher. In addition, since it contains 0.002–0.5 weight % of Ti, harmful non-metallic inclusions may be formed by melting in the atmosphere.

In addition, since the heat-resistant, austenitic cast steel disclosed in Japanese Patent Laid-Open No. 61-177352 contains a large amount of Ni, it may suffer from cracks when used in an atmosphere containing sulfur (S) at a high temperature.

Further, since the heat-resistant, austenitic cast steel disclosed in Japanese Patent Publication No. 57-8183 has a high carbon (C) content, it may become brittle when operated at a high temperature for a long period of time.

OBJECT AND SUMMARY OF THE INVENTION

Accordingly, an object of the present invention is to provide a heat-resistant, austenitic cast steel having excellent high-temperature strength and machinability, which can be produced at a low cost, thereby solving the above problems inherent in the conventional heat-resistant cast iron and heat-resistant cast steel.

Another object of the present invention is to provide an exhaust equipment member made of such heat-resistant cast steel.

As a result of intense research in view of the above objects, the inventors have found that by adding Nb, W and B and optionally Mo to the cast steel, the high-temperature strength of the cast steel can be improved and further that by adding S, REM (rare earth metals: Ce, La, Nb or Pr), Mg and/or Ca to the Fe-Ni-Cr base austenitic cast steel, its machinability and ductility at the room temperature can be improved. The present invention has been completed based upon this finding.

Thus, the heat-resistant, austenitic cast steel having excellent high-temperature strength and machinability according to a first embodiment of the present invention has a composition consisting essentially, by weight, of:

C: 0.1–0.6%,
Si: less than 1.5%,
Mn: 1% or less,
Ni: 8–20%,
Cr: 15–30%,
Nb: 0.2–1%,
W: 2–6%,
B: 0.001–0.01%,
S: 0.02–0.3 %, and
Fe and inevitable impurities: balance.

The heat-resistant, austenitic cast steel having excellent high-temperature strength and machinability according to a second embodiment of the present invention has a composition consisting essentially, by weight, of:

C: 0.1–0.6%,
Si: less than 1.5%,
Mn: 1% or less,
Ni: 8–20%,
Cr: 15–30%,
Nb: 0.2–1%,
W: 2–6%,
B: 0.001–0.01%, At least one element selected from the group consisting of Ce, La, Nd, Pr, Mg and Ca: 0.001–0.1%, and Fe and inevitable impurities: balance.

The heat-resistant, austenitic cast steel having excellent high-temperature strength and machinability according to a third embodiment of the present invention has a composition consisting essentially, by weight, of:

C: 0.1–0.6%,
Si: less than 1.5%,
Mn: 1% or less,
Ni: 8–20%,
Cr: 15–30%,
Nb: 0.2–1%,
W: 2–6%,
B: 0.001–0.01%,
S: 0.02–0.3 %, and At least one element selected from the group consisting of Ce, La, Nd, Pt, Mg and Ca: 0.001–0.1%, and Fe and inevitable impurities: balance.

The heat-resistant, austenitic cast steel having excellent high-temperature strength and machinability according to a fourth embodiment of the present invention has a composition consisting essentially, by weight, of:

C: 0.1–0.6%,
Si: less than 1.5%,
Mn: 1% or less,
Ni: 8–20%,
Cr: 15–30%,
Nb: 0.2–1%,
W: 2–6%,
N: 0.01–0.3%,
B: 0.001–0.01%,
S: 0.02–0.3 %, and
Fe and inevitable impurities: balance.

The heat-resistant, austenitic cast steel having excellent high-temperature strength and machinability according to an fifth embodiment of the present invention has a composition consisting essentially, by weight, of:

C: 0. 1–0.6%,
Si: less than 1.5%,
Mn: 1% or less,
Ni: 8–20%,
Cr: 15–30%,
Nb: 0.2–1%,
W: 2–6%,
N: 0.01–0.3%,
B: 0.001–0.01%, At least one element selected from the group consisting of Ce, La, Nd, Pr, Mg and Ca: 0.001–0.1%, and Fe and inevitable impurities: balance.

The heat-resistant, austenitic cast steel having excellent high-temperature strength and machinability according to an sixth embodiment of the present invention has a composition consisting essentially, by weight, of:

C: 0.1–0.6%,
Si: less than 1.5%,
Mn: 1% or less,
Ni: 8–20%,
Cr: 15–30%,
Nb: 0.2–1%,
W: 2–6%,
N: 0.01–0.3%,
B: 0.001–0.01%,
S: 0.02–0.3%, and At least one element selected from the group consisting of Ce, La, Nd, Pr, Mg and Ca: 0.001–0.1%, and Fe and inevitable impurities: balance.

The exhaust equipment member according to the present invention is made of any one of the above heat-resistant, austenitic cast steels.

DETAILED DESCRIPTION OF THE INVENTION

The present invention will be explained in detail below.

In each of the first to sixth embodiments of the present invention, the heat-resistant, austenitic cast steel has a composition shown in Table 1 below. In the following explanation, the amount of each element is expressed simply by "%," but it showed be noted that it means "% by weight."

TABLE 1

| | Embodiment | | | | | |
|---|---|---|---|---|---|---|
| Element | First % | Second % | Third % | Fourth % | Fifth % | Sixth % |
| C | 0.1–0.6 | 0.1–0.6 | 0.1–0.6 | 0.1–0.6 | 0.1–0.6 | 0.1–0.6 |
| Si | <1.5 | <1.5 | <1.5 | <1.5 | <1.5 | <1.5 |
| Mn | ≦1 | ≦1 | ≦1 | ≦1 | ≦1 | ≦1 |
| Ni | 8–20 | 8–20 | 8–20 | 8–20 | 8–20 | 8–20 |
| Cr | 15–30 | 15–30 | 15–30 | 15–30 | 15–30 | 15–30 |
| Nb | 0.2–1 | 0.2–1 | 0.2–1 | 0.2–1 | 0.2–1 | 0.2–1 |
| W | 2–6 | 2–6 | 2–6 | 2–6 | 2–6 | 2–6 |
| N | — | — | — | 0.01–0.3 | 0.01–0.3 | 0.01–0.3 |
| B | 0.001–0.01 | 0.001–0.01 | 0.001–0.01 | 0.001–0.01 | 0.001–0.01 | 0.001–0.01 |
| S | 0.02–0.3 | — | 0.02–0.3 | 0.02–0.3 | — | 0.02—0.3 |
| REM, etc.* | — | 0.001–0.1 | 0.001–0.1 | — | 0.001–0.1 | 0.001–0.1 |
| Fe | Bal. | Bal. | Bal. | Bal. | Bal. | Bal. |

Note:
*At least one element selected from the group consisting of REM (Ce, La, Nb or Pr), Mg and Ca.

In each heat-resistant, austenitic cast steel of the present invention, 0.2–1% of Mo may optionally be contained to improve the high-temperature strength.

The preferred amounts of elements in each heat-resistant, austenitic cast steel of the present invention are shown in Table 2 below.

TABLE 2

| | Embodiment | | | | | |
|---|---|---|---|---|---|---|
| Element | First % | Second % | Third % | Fourth % | Fifth % | Sixth % |
| C | 0.15–0.5 | 0.15–0.5 | 0.15–0.5 | 0.15–0.5 | 0.15–0.5 | 0.15–0.5 |
| Si | <1.5 | <1.5 | <1.5 | <1.5 | <1.5 | <1.5 |
| Mn | ≦1 | ≦1 | ≦1 | ≦1 | ≦1 | ≦1 |

TABLE 2-continued

| Element | Embodiment First % | Second % | Third % | Fourth % | Fifth % | Sixth % |
|---|---|---|---|---|---|---|
| Ni | 8–15 | 8–15 | 8–15 | 8–15 | 8–15 | 8–15 |
| Cr | 17–25 | 17–25 | 17–25 | 17–25 | 17–25 | 17–25 |
| Nb | 0.2–0.7 | 0.2–0.7 | 0.2–0.7 | 0.2–0.7 | 0.2–0.7 | 0.2–0.7 |
| W | 2–5 | 2–5 | 2–5 | 2–5 | 2–5 | 2–5 |
| N | — | — | — | 0.05–0.2 | 0.05–0.2 | 0.05–0.2 |
| B | 0.001—0.008 | 0.001—0.008 | 0.001—0.008 | 0.001—0.008 | 0.001—0.008 | 0.001—0.008 |
| S | 0.03–0.25 | — | 0.03–0.25 | 0.03–0.25 | — | 0.03–0.25 |
| REM, etc.* | — | 0.01–0.1 | 0.01–0.1 | — | 0.01–0.1 | 0.01–0.1 |
| Fe | Bal. | Bal. | Bal. | Bal. | Bal. | Bal. |

Note:
*At least one element selected from the group consisting of REM (Ce, La, Nb or Pr), Mg and Ca.

In each of the above preferred compositions, 0.3–1% of Mo may optionally be contained.

In the more preferred compositions of the first to third embodiments (not containing N), the amount of C is 0.2–0.5% by weight. Also, In the more preferred compositions of the fourth to sixth embodiments (containing N), the amount of C is 0.15–0.45% by weight.

The reasons for restricting the composition range of each alloy element in the heat-resistant, austenitic cast steel of the present invention having excellent high-temperature strength and machinability will be explained below.

(1) C(carbon): 0.1–0.6 %

C has a function of improving the fluidity and castability of a melt and also partly dissolves into a matrix phase, thereby exhibiting a solution strengthening function. Besides, it forms primary carbides, thereby improving a high-temperature strength. To exhibit such functions effectively, the amount of C should be 0.1% or more. On the other hand, when the amount of C exceeds 0.6%, secondary carbides are excessively precipitated, leading to a poor toughness. Accordingly, the amount of C is 0.1–0.6%. The preferred amount of C is 0.15–0.5%.

(2) Si (silicon): less than 1.5%

Si has a function as a deoxidizer and also is effective for improving an oxidation resistance. However, when it is excessively added, the austenite structure of the cast steel become unstable, leading to a poor high-temperature strength. Accordingly, the amount of Si should be less than 1.5%.

(3) Mn (manganese): 1% or less

Mn is effective like Si as a deoxidizer for the melt. However, when it is excessively added, its oxidation resistance is deteriorated. Accordingly, the amount of Mn is 1% or less.

(4) Ni (nickel): 8–20%

Ni is an element effective for forming and stabilizing an austenite structure of the heat-resistant cast steel of the present invention, together with Cr, thereby improving a high-temperature strength. Particularly, to have a good high-temperature strength at 900° C. or higher, the amount of Ni should be 8% or more. As the amount of Ni increases, such effects increase. However, when it exceeds 20%, the effects level off. This means that the amount of Ni exceeding 20% is economically disadvantageous. Accordingly, the amount of Ni is 8–20%. The preferred amount of Ni is 8–15%.

(5) Cr (chromium): 15–30%

Cr is an element capable of austenizing the cast steel structure when it coexists with Ni, improving high-temperature strength and oxidation resistance. It also forms carbides, thereby further improving the high-temperature strength. To exhibit effectively such effects at a high temperature of 900° C. or higher, the amount of Cr should be 15% or more. On the other hand, when it exceeds 30%, secondary carbides are excessively precipitated and a brittle σ-phase, etc. are also precipitated, resulting in an extreme brittleness. Accordingly, the amount of Cr should be 15–30%. The preferred amount of Cr is 17–25%.

(6) W (tungsten): 2–6%

W has a function of improving the high-temperature strength. To exhibit such an effect effectively, the amount of W should be 2% or more. However, it is excessively added, the oxidation resistance is deteriorated. Thus, the upper limit of W is 6%. Accordingly, the amount of W is 2–6%. The preferred amount of W is 2–5%.

(7) Mo (molybdenum): 0.2–1%

Mo has functions which are similar to those of W. However, by the addition of Mo alone, less effects are obtainable than a case where W is used alone. Accordingly, to have synergistic effects with W, the amount of Mo should be 0.2–1%. The preferred amount of Mo is 0.3–1%.

(8) Nb (niobium): 0.2–1%

Nb forms fine carbides when combined with C, increasing the high-temperature strength. Also, by suppressing the formation of the Cr carbides, it functions to improve the oxidation resistance. For such purposes, the amount of Nb should be 0.2% or more. However, if it is excessively added, the toughness of the resulting austenitic cast steel is deteriorated. Accordingly, the upper limit of Nb is 1%. Therefore, the amount of Nb should be 0.2– 1%. The preferred amount of Nb is 0.2–0.7%.

(9) N (nitrogen): 0.01–0.3 %

N is an element effective to produce an austenite structure and to stabilize an austenite matrix. It is also effective to make crystal grains finer. Thus, it is particularly useful for casting materials of the present invention where it is impossible to produce fine crystal grains by forging, rolling, etc. Since N is also effective to retard the diffusion of C and the condensation of precipitated carbides, it is effective to deter embrittlement. To exhibit such functions effectively, the amount of N should be 0.01% or more. On the other hand, when the amount of N exceeds 0.3%, $Cr_2N$—$Cr_{23}C_6$ is precipitated in the crystal grain boundaries, causing embrittlement and reducing an amount of effective Cr. Thus, the upper limit of N is 0.3%. Accordingly, the amount of N is 0.01–0.3%. The preferred amount of N is 0.05–0.2%. Incidentally, in the heat-resistant, austenitic cast steel of the present invention containing W, Mo and Nb for improving a high-temperature strength, N is effective to improve the stability of the austenite matrix since W, Mo and Nb are ferrite-forming elements likely to unstabilize the austenite matrix.

(10) B (boron): 0.001–0.01%

B has a function of strengthening the crystal grain boundaries of the cast steel and making carbides in the grain boundaries finer and further deterring the agglomeration and growth of such carbides, thereby improving the high-temperature strength and toughness of the heat-resistant, austenitic cast steel. Accordingly, the amount of B is desirably 0.001% or more. However, if it is excessively added, borides are precipitated, leading to a poor high-temperature strength. Thus, the upper limit of B is 0.01%. Therefore, the amount of B is 0.001–0.01%. The preferred amount of B is 0.001–0.008%.

(11) S (sulfur): 0.02–0.3%

S has a function of forming fine spheroidal or granular sulfide particles in the cast steel, thereby improving machinability thereof, namely accelerating the separation of chips from a work being machined. To exhibit such an effect, the amount of S should be 0.02% or more. However, when it is excessingly added, sulfide particles are excessingly precipitated in grain boundaries, leading to a poor high-temperature strength. Thus, the upper limit of S is 0.3%. Therefore, the amount of S is 0.02–0.3%. The preferred amount of S is 0.03–0.25%.

(12) At least one of REM (rare earth metals), Mg (magnesium) and Ca (calcium): 0.001–0.1%

REM selected from the group consisting of Ce (cerium), La (lanthanum), Nb (niobium) and Pr (praseodymium), Mg and Ca are dispersed in the form of non-metallic inclusions in a matrix of the cast steel. Thus, they work to separate chips from a work being machined. Thus, they serve to improve the machinability of the cast steel. Since their non-metallic inclusions are in the form of sphere or granule, a room-temperature ductility of the cast steel is improved. To exhibit such an effect, the amount of REM, Mg and Ca should be 0.001% or more. However, when they are excessively added, the amount of the non-metallic inclusions increases, leading to poor ductility. Thus, the upper limit of REM, Mg and Ca is 0.1%. Accordingly, the amount of REM, Mg and Ca is 0.001–0.1%. The preferred amount of REM, Mg and Ca is 0.01–0.1%.

Such heat-resistant, austenitic cast steel of the present invention is particularly suitable for thin parts such as exhaust equipment members, exhaust manifolds, turbine housings, etc. for automobile engines which should be durable without suffering from cracks under heating-cooling cycles.

The present invention will be explained in detail by way of the following Examples.

Examples 1–20. and Comparative Examples 1–3

With respect to heat-resistant, austenitic cast steels having compositions shown in Table 3, Y-block test pieces (No. B according to JIS) were prepared by casting. Incidentally, the casting was conducted by melting the steel in the atmosphere in a 100-kg high-frequency furnace, removing the resulting melt from the furnace while it was at a temperature of 1550° C. or higher, and pouring it into a mold at about 1500° C. or higher. The heat-resistant, austenitic cast steels of the present invention (Examples 1–20) showed good fluidity at casting, thereby generating no cast defects such as voids.

Next, test pieces (Y-blocks) of Examples 1–20 and Comparative Examples 1–3 were subjected to a heat treatment comprising heating them at 800° C. for 2 hours in a furnace and cooling them in the air.

Incidentally, the test pieces of Comparative Examples 1–3 in Table 3 are those used for heat-resistant parts such as turbo charger housings, exhaust manifolds, etc. for automobiles. The test pieces of Comparative Examples 1 and 2 are D2 and D5S of NI-RESIST cast iron. The test piece of Comparative Example 3 is a conventional heat-resistant, austenitic cast steel SCH-12 according to JIS.

TABLE 3

| | Additive Component (Weight %) | | | | | | |
|---|---|---|---|---|---|---|---|
| No. | C | Si | Mn | Ni | Cr | Mo | W |
| Example | | | | | | | |
| 1 | 0.21 | 1.11 | 0.48 | 8.6 | 15.50 | — | 2.12 |
| 2 | 0.31 | 0.78 | 0.52 | 10.11 | 19.50 | — | 3.05 |
| 3 | 0.55 | 0.88 | 0.46 | 19.50 | 28.60 | — | 5.82 |
| 4 | 0.42 | 0.58 | 0.62 | 12.50 | 21.30 | — | 3.43 |
| 5 | 0.45 | 1.02 | 0.53 | 10.45 | 20.03 | — | 3.12 |
| 6 | 0.25 | 1.05 | 0.38 | 9.50 | 16.10 | 0.25 | 2.85 |
| 7 | 0.35 | 0.95 | 0.46 | 10.15 | 20.13 | 0.95 | 1.52 |
| 8 | 0.41 | 0.98 | 0.53 | 10.46 | 21.05 | 0.52 | 2.02 |
| 9 | 0.58 | 1.45 | 0.62 | 18.95 | 29.05 | 0.52 | 2.11 |
| 10 | 0.40 | 1.13 | 0.52 | 10.08 | 20.05 | 0.55 | 2.18 |
| 11 | 0.12 | 1.01 | 0.52 | 8.30 | 15.80 | — | 2.50 |
| 12 | 0.25 | 0.91 | 0.48 | 10.56 | 20.05 | — | 3.55 |
| 13 | 0.48 | 0.95 | 0.58 | 19.82 | 29.50 | — | 5.91 |
| 14 | 0.35 | 0.86 | 0.45 | 13.50 | 25.10 | — | 4.20 |
| 15 | 0.32 | 0.89 | 0.50 | 9.95 | 22.05 | — | 3.01 |
| 16 | 0.13 | 1.12 | 0.54 | 8.15 | 15.65 | 0.25 | 2.44 |
| 17 | 0.22 | 0.95 | 0.51 | 11.25 | 21.08 | 0.58 | 2.05 |
| 18 | 0.47 | 0.88 | 0.44 | 19.72 | 29.13 | 0.88 | 1.52 |
| 19 | 0.31 | 0.92 | 0.53 | 12.95 | 24.95 | 0.49 | 2.35 |
| 20 | 0.28 | 0.97 | 0.54 | 10.08 | 20.15 | 0.53 | 2.41 |
| Comparative Example | | | | | | | |
| 1 | 2.77 | 2.12 | 0.88 | 21.10 | 2.44 | — | — |
| 2 | 1.89 | 5.32 | 0.41 | 34.50 | 2.35 | — | — |
| 3 | 0.21 | 1.24 | 0.50 | 9.10 | 18.80 | — | — |

| | Additive Component (Weight %) | | | | | | |
|---|---|---|---|---|---|---|---|
| No. | Nb | N | B | S | REM | Mg | Ca |
| Example | | | | | | | |
| 1 | 0.31 | — | 0.0015 | 0.035 | — | — | — |
| 2 | 0.45 | — | 0.0040 | 0.008 | 0.08 | — | — |
| 3 | 0.94 | — | 0.0082 | 0.25 | — | 0.005 | — |
| 4 | 0.46 | — | 0.0035 | 0.05 | — | — | 0.005 |
| 5 | 0.49 | — | 0.0038 | 0.11 | 0.06 | 0.005 | 0.005 |
| 6 | 0.36 | — | 0.0021 | 0.06 | — | — | — |
| 7 | 0.49 | — | 0.0034 | 0.003 | 0.08 | — | — |
| 8 | 0.53 | — | 0.0085 | 0.10 | — | 0.005 | — |
| 9 | 0.88 | — | 0.0041 | 0.22 | — | — | 0.005 |
| 10 | 0.48 | — | 0.0031 | 0.11 | 0.06 | 0.005 | 0.005 |
| 11 | 0.25 | 0.25 | 0.002 | 0.034 | — | — | — |
| 12 | 0.48 | 0.08 | 0.008 | 0.09 | 0.06 | — | — |
| 13 | 0.96 | 0.02 | 0.009 | 0.28 | — | 0.005 | — |
| 14 | 0.51 | 0.09 | 0.004 | 0.15 | — | — | 0.005 |
| 15 | 0.45 | 0.12 | 0.004 | 0.08 | 0.06 | 0.008 | 0.005 |
| 16 | 0.23 | 0.26 | 0.003 | 0.22 | — | — | — |
| 17 | 0.44 | 0.15 | 0.004 | 0.04 | 0.08 | — | — |
| 18 | 0.48 | 0.03 | 0.005 | 0.07 | — | 0.005 | — |
| 19 | 0.51 | 0.11 | 0.004 | 0.09 | — | — | 0.005 |
| 20 | 0.55 | 0.09 | 0.004 | 0.10 | 0.06 | 0.008 | 0.005 |
| Comparative Example | | | | | | | |
| 1 | — | — | — | — | — | 0.05 | — |
| 2 | — | — | — | — | — | 0.07 | — |
| 3 | — | — | — | — | — | — | — |

Next, with respect to each cast test piece, the following evaluation tests were conducted.

(1) Tensile test at a room temperature

Conducted on a rod test piece having a gauge distance of 50 mm and a gauge diameter of 14 mm (No. 4 test piece according to JIS).

(2) Tensile test at a high temperature

Conducted on a flanged test piece having a gauge distance of 50 mm and a gauge diameter of 10 mm at temperatures of 1000° C.

(3) Thermal fatigue test

Using a rod test piece having a gauge distance of 20 mm and a gauge diameter of 10 mm, a heating-cooling cycle was repeated to cause thermal fatigue failure in a state where expansion and shrinkage due to heating and cooling were completely restrained mechanically, under the following conditions:

Lowest temperature: 150° C.,

Highest temperature: 1000° C., and

Each 1 cycle: 7 minutes.

Incidentally, an electric-hydraulic servo-type thermal fatigue test machine was used for the test.

(4) Oxidation test

A rod test piece having a diameter of 10 mm and a length of 20 mm was kept in the air at 1000° C. for 200 hours, and its oxide scale was removed by a shot blasting treatment to measure a weight variation per a unit surface area. By calculating oxidation weight loss (mg/mm$^2$) after the oxidation test, the oxidation resistance was evaluated.

(5) Machinability test

A drilling test was conducted to evaluate machinability which is most critical at drilling a work made of this kind of materials. A test piece made of each cast steel was drilled ten times to measure an amount of flank wear of the drill and calculate the flank wear per one cut hole under the following conditions:

Machine tool: Vertical Machining Center (5.5 kW),

Drill: Solid Carbide Drill (6.8 mm in diameter),

Cutting Speed: 40 m/min,

Feed Speed: 0.2 mm/rev., step feed,

Hole Depth: 20 mm,

Entire Length of Drill: 42 mm, and

Cutting Fluid: Oil.

The results of the tensile test at a room temperature, the tensile test at 1000° C., the thermal fatigue test and the oxidation test, and the drilling test are shown in Tables 4, 5, 6 and 7, respectively.

TABLE 4

| No. | at Room Temperature | | | |
|---|---|---|---|---|
| | 0.2% Offset Yield Strength (MPa) | Tensile Strength (MPa) | Elongation (%) | Hardness ($H_B$) |
| Example | | | | |
| 1 | 255 | 585 | 19 | 170 |
| 2 | 305 | 595 | 13 | 179 |
| 3 | 375 | 635 | 13 | 223 |
| 4 | 325 | 600 | 10 | 207 |
| 5 | 340 | 605 | 11 | 207 |
| 6 | 315 | 600 | 17 | 197 |
| 7 | 310 | 590 | 15 | 197 |
| 8 | 295 | 600 | 12 | 207 |
| 9 | 370 | 625 | 13 | 217 |
| 10 | 330 | 615 | 11 | 207 |
| 11 | 260 | 600 | 15 | 179 |
| 12 | 300 | 600 | 20 | 187 |
| 13 | 380 | 650 | 15 | 197 |

TABLE 4-continued

| No. | at Room Temperature | | | |
|---|---|---|---|---|
| | 0.2% Offset Yield Strength (MPa) | Tensile Strength (MPa) | Elongation (%) | Hardness ($H_B$) |
| 14 | 340 | 615 | 18 | 223 |
| 15 | 355 | 620 | 16 | 207 |
| 16 | 330 | 615 | 23 | 187 |
| 17 | 315 | 610 | 20 | 197 |
| 18 | 300 | 605 | 15 | 207 |
| 19 | 365 | 640 | 16 | 217 |
| 20 | 317 | 610 | 15 | 207 |
| Comparative Example | | | | |
| 1 | 190 | 455 | 16 | 179 |
| 2 | 255 | 485 | 9 | 163 |
| 3 | 250 | 560 | 20 | 170 |

TABLE 5

| No. | at 1000° C. | | |
|---|---|---|---|
| | 0.2% Offset Yield Strength (MPa) | Tensile Strength (MPa) | Elongation (%) |
| Example | | | |
| 1 | 40 | 69 | 52 |
| 2 | 48 | 82 | 28 |
| 3 | 70 | 110 | 32 |
| 4 | 60 | 95 | 48 |
| 5 | 54 | 90 | 60 |
| 6 | 50 | 86 | 36 |
| 7 | 56 | 95 | 30 |
| 8 | 62 | 93 | 24 |
| 9 | 72 | 115 | 45 |
| 10 | 65 | 105 | 38 |
| 11 | 42 | 73 | 62 |
| 12 | 50 | 84 | 35 |
| 13 | 72 | 115 | 40 |
| 14 | 65 | 98 | 52 |
| 15 | 56 | 84 | 40 |
| 16 | 52 | 88 | 48 |
| 17 | 55 | 98 | 35 |
| 18 | 65 | 90 | 30 |
| 19 | 77 | 118 | 52 |
| 20 | 68 | 110 | 42 |
| Comparative Example | | | |
| 1 | 30 | 41 | 33 |
| 2 | 33 | 44 | 29 |
| 3 | 35 | 55 | 49 |

TABLE 6

| No. | Thermal Fatigue Life (Cycle) | Weight Loss by Oxidation (mg/mm$^2$) |
|---|---|---|
| Example | | |
| 1 | 92 | 50 |
| 2 | 105 | 40 |
| 3 | 155 | 18 |
| 4 | 208 | 38 |
| 5 | 240 | 35 |
| 6 | 175 | 45 |
| 7 | 195 | 30 |
| 8 | 168 | 25 |
| 9 | 215 | 16 |
| 10 | 200 | 28 |
| 11 | 109 | 52 |

TABLE 6-continued

| No. | Thermal Fatigue Life (Cycle) | Weight Loss by Oxidation ($mg/mm^2$) |
|---|---|---|
| 12 | 120 | 46 |
| 13 | 170 | 20 |
| 14 | 225 | 35 |
| 15 | 265 | 38 |
| 16 | 190 | 50 |
| 17 | 205 | 35 |
| 18 | 184 | 30 |
| 19 | 230 | 15 |
| 20 | 220 | 30 |
| Comparative Example | | |
| 1 | 56 | 765 |
| 2 | 85 | 55 |
| 3 | 80 | 85 |

TABLE 7

| No. | Flank Wear per One Cut Hole (mm) |
|---|---|
| Example | |
| 1 | 0.022 |
| 2 | 0.035 |
| 3 | 0.005 |
| 4 | 0.012 |
| 5 | 0.008 |
| 6 | 0.042 |
| 7 | 0.015 |
| 8 | 0.009 |
| 9 | 0.006 |
| 10 | 0.007 |
| 11 | 0.045 |
| 12 | 0.033 |
| 13 | 0.005 |
| 14 | 0.006 |
| 15 | 0.007 |
| 16 | 0.005 |
| 17 | 0.038 |
| 18 | 0.012 |
| 19 | 0.009 |
| 20 | 0.006 |
| Comparative Example | |
| 1 | 0.005 |
| 2 | 0.005 |
| 3 | 0.095 |

As is clear from Tables 4–6, the test pieces of Examples 1–20 are comparable to or even superior to those of Comparative Examples 1 and 2 (NI-RESIST D2 and D5S) with respect to properties at a room temperature, and particularly superior with respect to the high-temperature strength. In addition, as shown in Table 7, the test pieces of Examples 1–20 are superior to that of Comparative Example 3 (SCH12) with respect to the flank wear of a drill and the machinability.

Next, an exhaust manifold (thickness: 2.5–3.4 mm) and a turbine housing (thickness: 2.7–4.1 mm) were produced by casting the heat-resistant, austenitic cast steel of Examples 5 and 15. All of the resulting heat-resistant cast steel parts were free from casting defects. These cast parts were machined to evaluate their cuttability. As a result, no problem was found in any cast parts.

Further, the exhaust manifold and the turbine housing were mounted to a high-performance, straight-type, four-cylinder, 2000-cc gasoline engine (test machine) to conduct a durability test. The test was conducted by repeating 500 heating-cooling (Go-Stop) cycles each consisting of a continuous full-load operation at 6000 rpm (14 minutes), idling (1 minute), complete stop (14 minutes) and idling (1 minute) in this order. The exhaust gas temperature under a full load was 1050° C. at the inlet of the turbo charger housing. Under this condition, the highest surface temperature of the exhaust manifold was about 980° C. in a pipe-gathering portion thereof, and the highest surface temperature of the turbo charger housing was about 1020° C. in a waist gate portion thereof. As a result of the evaluation test, no gas leak and thermal cracking were observed. It was thus confirmed that the exhaust manifold and the turbine housing made of the heat-resistant, austenitic cast steel of the present invention had excellent durability and reliability.

As described above in detail, the heat-resistant, austenitic cast steel of the present invention has an excellent high-temperature strength, particularly at 900° C. or higher, without deteriorating a room-temperature ductility, and it can be produced at a low cost. Such heat-resistant, austenitic cast steel of the present invention is particularly suitable for exhaust equipment members for engines, etc. such as exhaust manifolds, turbine housings, etc. The exhaust equipment members made of such heat-resistant, austenitic cast steel according to the present invention has excellent high-temperature strength, thereby showing extremely good durability.

What is claimed is:

1. A heat-resistant, austenitic cast steel having a composition consisting essentially, by weight, of:

C: 0.1–0.6%,

Si: less than 1.5%,

Mn: 1% or less,

Ni: 8–20%,

Cr: 15–30%,

Nb: 0.2–1%,

W: 2–6%,

B: 0.001–0.01%,

S: 0.02–0.3%, and

At least one element selected from the group consisting of Ce, La, Nd, Pr, Mg and Ca: 0.001–0.1%, and Fe and inevitable impurities: balance.

2. The heat-resistant, austenitic cast steel according to claim 1, wherein said heat-resistant, austenitic cast steel further contains 0.2–1% of Mo.

3. A heat-resistant, austenitic cast steel having a composition consisting essentially, by weight, of:

C: 0.1–0.6%,

Si: less than 1.5%,

Mn: 1% or less,

Ni: 8–20%,

Cr: 15–30%,

Nb: 0.2–1%,

W: 2–6%,

N: 0.01–0.3%,

B: 0.001–0.01%,

S: 0.02–0.3%, and

At least one element selected from the group consisting of Ce, La, Nd, Pr, Mg and Ca: 0.001–0.1%, and Fe and inevitable impurities: balance.

4. The heat-resistant, austenitic cast steel according to claim 3, wherein said heat-resistant, austenitic cast steel further contains 0.2–1% of Mo.

5. An exhaust equipment member made of a heat-resistant, austenitic cast steel according to claim 1.

6. An exhaust equipment member made of a heat-resistant, austenitic cast steel according to claim 2.

7. An exhaust equipment member made of a heat-resistant, austenitic cast steel according to claim 3.

8. An exhaust equipment member made of a heat-resistant, austenitic cast steel according to claim 4.

* * * * *

UNITED STATES PATENT AND TRADEMARK OFFICE

CERTIFICATE OF CORRECTION

PATENT NO. : 5,489,416

DATED : February 6, 1996

INVENTOR(S) : Norio TAKAHASHI et al.

It is certified that error appears in the above-indentified patent and that said Letters Patent is hereby corrected as shown below:

In the Abstract, line 6, "Pt" should read --Pr--.

Signed and Sealed this

Fourteenth Day of May, 1996

*Attest:*

Bruce Lehman

BRUCE LEHMAN

*Attesting Officer*

*Commissioner of Patents and Trademarks*